US008038261B2

(12) United States Patent
Koizumi

(10) Patent No.: US 8,038,261 B2
(45) Date of Patent: Oct. 18, 2011

(54) DROPLET JETTING HEAD

(75) Inventor: Hiroshi Koizumi, Hiratsuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 547 days.

(21) Appl. No.: 12/235,941

(22) Filed: Sep. 23, 2008

(65) Prior Publication Data

US 2009/0079792 A1 Mar. 26, 2009

(30) Foreign Application Priority Data

Sep. 25, 2007 (JP) ..... P2007-248135

(51) Int. Cl.
*B41J 2/14* (2006.01)
*B41J 2/16* (2006.01)

(52) U.S. Cl. ..... 347/47; 347/68

(58) Field of Classification Search ..... 347/13, 347/40, 42, 43, 44, 47, 48, 68–72
See application file for complete search history.

(56) References Cited

U.S. PATENT DOCUMENTS

| | | | | |
|---|---|---|---|---|
| 5,581,283 | A * | 12/1996 | Rogers | 347/40 |
| 5,767,873 | A * | 6/1998 | Rogers et al. | 347/40 |
| 6,074,038 | A * | 6/2000 | Takada et al. | 347/40 |
| 6,179,408 | B1 * | 1/2001 | Rogers et al. | 347/40 |

FOREIGN PATENT DOCUMENTS

| | | |
|---|---|---|
| JP | 6-115087 | 4/1994 |
| JP | 2005-270743 | 10/2005 |

* cited by examiner

*Primary Examiner* — Thinh Nguyen
(74) *Attorney, Agent, or Firm* — Oblon, Spivak, McClelland, Maier & Neustadt, L.L.P.

(57) ABSTRACT

A droplet jetting head includes a nozzle plate having multiple nozzles arranged in a single line and multiple liquid passages respectively communicating with the multiple nozzles and extending in the same direction, a liquid chamber plate having multiple liquid chambers provided in the multiple liquid passages and configured to respectively communicate with the multiple liquid passages, and multiple piezoelectric elements provided so that an end of each of the piezoelectric elements can face a corresponding one of the multiple liquid chambers. Here, the distance between each of the nozzles and the corresponding liquid chamber communicating with the nozzle is changed in a cycle.

3 Claims, 2 Drawing Sheets

DROPLET JETTING HEAD

CROSS REFERENCE OF THE RELATED APPLICATION

This application is based on and claims the benefit of priority from Japanese Patent Application No. 2007-248135, filed on Sep. 25, 2007; the entire contents of which are incorporated herein by reference.

BACKGROUND OF THE INVENTION

1. Field of the Invention

The present invention relates to a droplet jetting head configured to jet droplets.

2. Description of the Related Art

A droplet jetting applicator is used for printing image information and also in a process for forming a color filter, a black matrix, a conductive film, and the like, in manufacturing various flat display devices such as a liquid crystal display device, an organic EL (electro luminescence) display device, an electron emission display device, a plasma display device or an electrophoretic display device. This droplet jetting applicator includes a droplet jetting head (such as an inkjet head) for jetting liquid such as ink as droplets from multiple nozzles. The droplet jetting head makes the droplets land on application targets, sequentially forms dot arrays in a predetermined pattern, and thereby manufactures various coated bodies.

The droplet jetting head is configured to change volumes of multiple liquid chambers for containing liquid by use of multiple piezoelectric elements, and to jet the liquid in those liquid chambers from respective nozzles, i.e. nozzle orifices. The droplet jetting head includes a liquid chamber plate (an intermediate plate) having the liquid chambers, and a nozzle plate for connecting those liquid chambers and the nozzle orifices, respectively (see JP-A No. 2005-270743, for example). Here, the piezoelectric elements are arranged in two straight lines and the adjacent piezoelectric elements are arranged away from each other at a pitch of a minimum distance required to avoid interference with each other.

However, when the piezoelectric elements are arranged in the two straight lines at the pitch of the minimum distance as described above, new piezoelectric elements cannot be provided between the adjacent piezoelectric elements in order to increase the number of nozzles. Thus, it is impossible to reduce the pitch of the nozzle orifices. For this reason, when the number of the nozzles is increased, the droplet jetting head extends in the direction of arrangement of the nozzle orifices. That leads to a size increase of the droplet jetting head.

SUMMARY OF THE INVENTION

An object of the present invention is to provide a droplet jetting head capable of preventing a size increase attributable to an increase in the number of nozzles.

An aspect of an embodiment of the present invention provides a droplet jetting head which includes a nozzle plate having multiple nozzles arranged in a single line and multiple liquid passages respectively communicating with the multiple nozzles and extending in the same direction, a liquid chamber plate having multiple liquid chambers provided in the multiple liquid passages and configured to respectively communicate with the multiple liquid passages, and multiple piezoelectric elements provided so that an end of each of the piezoelectric elements can face a corresponding one of the multiple liquid chambers. Here, the distance between each of the nozzles and the corresponding liquid chamber communicating with the nozzle is changed in a cycle.

DESCRIPTION OF THE PREFERRED EMBODIMENTS

An embodiment of the present invention will be described with reference to the drawings.

Figure 1:
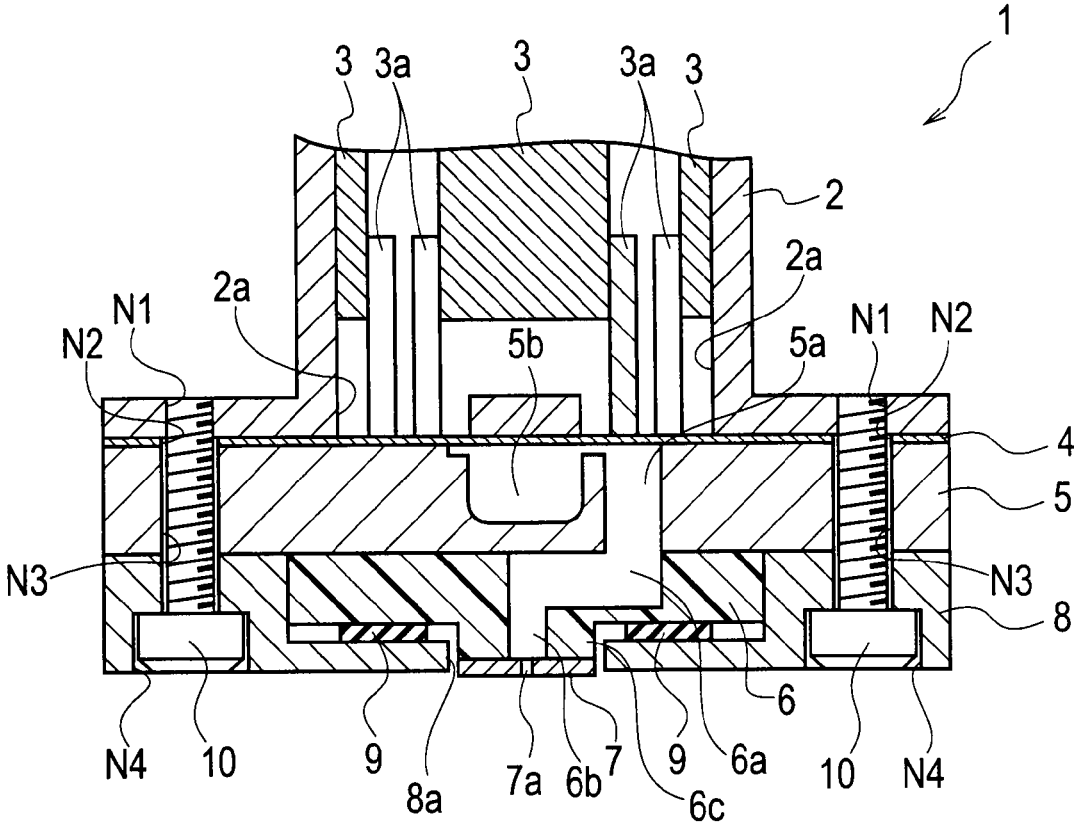
FIG. 1 is a cross-sectional view showing a schematic configuration of a droplet jetting head according to an embodiment of the present invention.

As shown in FIG. 1, a droplet jetting head 1 according to the embodiment of the present invention includes a base member 2 constituting a body base, a holding member 3 provided inside the base member 2 and configured to hold multiple piezoelectric elements 3*a*, a vibration plate (a diaphragm plate) 4 to be vibrated by the piezoelectric elements 3*a*, a liquid chamber plate 5 having multiple liquid chambers 5*a* each configured to contain liquid such as ink and to have a variable volume caused by the vibration plate 4, a nozzle plate 6 having multiple nozzles 6*b* communicating with the liquid chambers 5*a* through the liquid passages 6*a*, respectively, an orifice plate 7 having multiple orifices 7*a* corresponding to the respective liquid chambers 5*a*, a holder plate 8 provided with an aperture 8*a* for exposing the orifice plate 7 and configured to cover the nozzle plate 6, a buffer member 9 provided between the holder plate 8 and the nozzle plate 6, and multiple screws 10 for fastening the base member 2, the vibration plate 4, the liquid chamber plate 5, and the holder plate 8.

The base member 2 is made of a metallic material such as stainless steel. Two insertion slots 2*a* for inserting the respective piezoelectric elements 3*a* and multiple screw holes N1 for inserting the screws 10 are formed in this base member 2. Each of the insertion slots 2*a* is formed into a rectangular shape, for example, and the insertion slots 2*a* are arranged in a line substantially in the center on a surface of the base member 2. Meanwhile, the screw holes N1 are formed on a peripheral portion of the base member 2. Screw threads constituting female screws, for example, are formed inside these screw holes N1.

Figure 2:
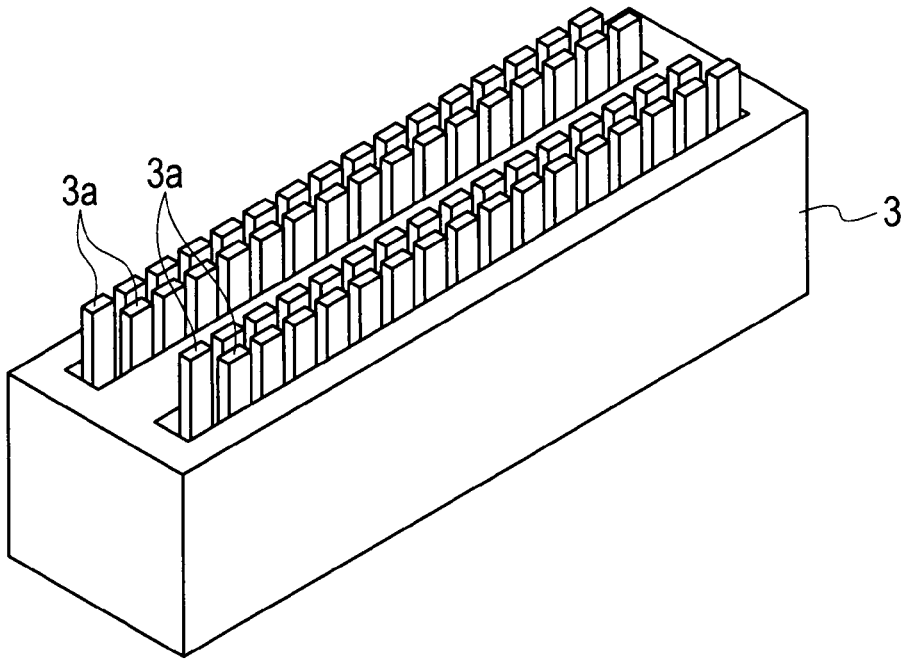
FIG. 2 is a perspective view showing a schematic configuration of piezoelectric elements and a holing member included in the droplet jetting head shown in FIG. 1.
Figure 3:
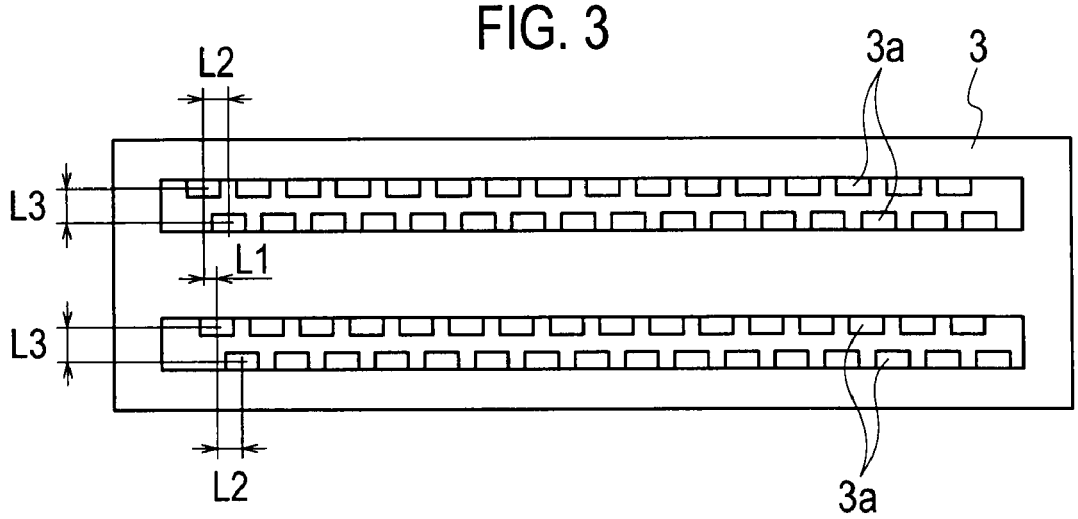
FIG. 3 is a plan view showing the schematic configuration of the piezoelectric elements and the holing member shown in FIG. 2.

The holding member 3 is made of a metallic material such as stainless steel as similar to the base member 2. As shown in FIGS. 2 and 3, the piezoelectric elements 3*a* are arranged in four lines in a zigzag manner. As shown in FIG. 1, each of these piezoelectric elements 3*a* is inserted into the insertion slot 2*a* of the base member 2 so that one tip end of the piezoelectric elements 3*a* contacts the vibration plate 4, and is located inside the base member 2 together with the holding member 3. Here, the tip of the piezoelectric element 3*a* is attached and fixed to the vibration plate 4. Wires for applying voltages are connected to these piezoelectric elements 3*a*. When voltages are applied to the respective piezoelectric elements 3*a*, the vibration plate 4 is vibrated by expansion and contraction of the piezoelectric elements 3*a*.

Multiple screw holes N2 for inserting the screws 10 are formed in the vibration plate 4. These screw holes N2 are through holes penetrating the vibration plate 4, and are formed in a peripheral portion of the vibration plate 4. Here, each of the screw holes N2 is formed in a position collinear with the screw hole N1. The vibration plate 4 is deformed by expansion or contraction of the piezoelectric elements 3*a* and this causes the volumes of the liquid chambers 5*a* in the liquid chamber plate 5 to be increased or decreased. In this way, the liquid inside each of the liquid chambers 5*a* is ejected as droplets from the orifice 7*a* through the liquid passage 6*a*.

The liquid chamber plate 5 is made of a material such as metal or ceramic. The liquid passages 5*a* for respectively containing the liquid, a main passage 5*b* such as a manifold to communicate with these liquid chambers 5*a*, and multiple screw holes N3 for inserting the screws 10 are formed in this liquid chamber plate 5. The main passage 5*b* is formed in a straight line shape substantially in the center of the liquid chamber plate 5. The liquid chambers 5*a* are containers for containing the liquid supplied from the main passage 5*b*. The liquid chambers 5*a* are provided in four lines so as to interpose the main passage 5*b* therebetween. Part of inner walls of these liquid chambers 5*a* is formed by a surface of the vibration plate 4. The liquid is supplied from an external liquid tank to the main passage 5*b* through a supply path such as a tube (not shown). The screw holes N3 are through holes penetrating the liquid chamber plate 5, and are provided in a peripheral portion of the liquid chamber plate 5. Here, each of the screw holes N3 is formed in a position collinear with the screw hole N1.

The nozzle plate 6 is made of a material such as glass, ceramic or resin. This nozzle plate 6 is formed so as to protrude in the aperture 8*a* of the holder plate 8. Specifically, the nozzle plate 6 is provided with a protrusion 6*c* to be inserted in the aperture 8*a* of the nozzle plate 8. Meanwhile, the nozzle plate 6 is provided with the multiple liquid passages 6*a* communicating with the liquid chambers 5*a*, respectively, and the multiple nozzles 6*b* communicating with the liquid passages 6*a* and the orifices 7*a*, respectively. Here, the orifices 7*a* function as nozzle orifices.

The orifice plate 7 is made of a material such as stainless steel or silicone. This orifice plate 7 is provided with the orifices 7*a* arranged in one line in the direction of arrangement of the piezoelectric elements 3*a*, for example. The droplets are ejected from these orifices 7*a*. The orifice plate 7 is provided on the projection 6*c* of the nozzle plate 6 so that the orifices 7*a* can communicate with the corresponding liquid passages 6*a*.

Figure 4:
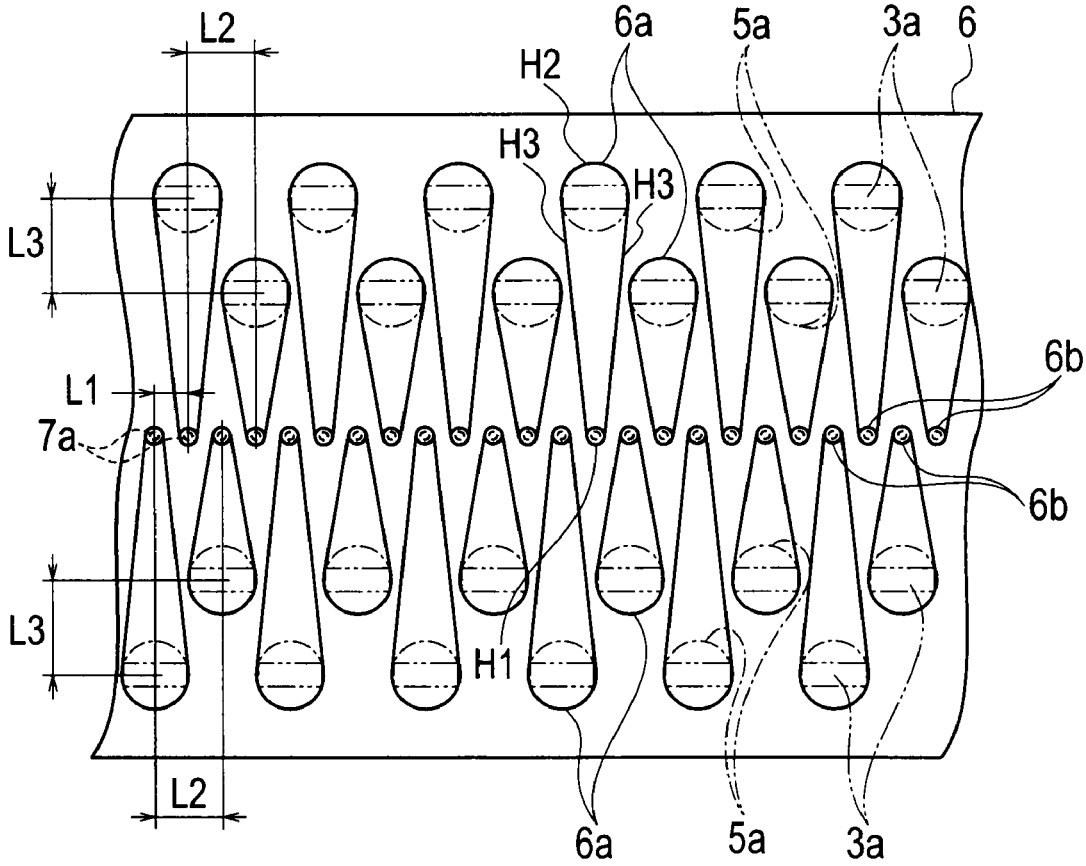
FIG. 4 is an explanatory view for explaining positional relations among nozzle orifices, liquid chambers, and the piezoelectric elements in the droplet jetting head shown in FIG. 1.

Here, as shown in FIG. 4, the piezoelectric elements 3*a* are located in a zigzag manner in four lines at a pitch (an interval distance) L1 (see also FIG. 3). Here, the pitch L1 is the pitch of the orifices 7*a* which is about 0.7 mm, for example. To be more precise, the piezoelectric elements 3*a* are arranged in two lines on both sides of a straight line passing through the orifices 7*a* defined as a center, i.e. four lines in total. In this case, the piezoelectric elements 3*a* arranged in the two lines are cyclically provided into a triangular waveform at a pitch (an interval distance) L2. The lines are separated from each other at an interval distance L3. Meanwhile, the liquid chambers 5*a* are also arranged in four lines in a zigzag manner so as to correspond to the piezoelectric elements 3*a*. To be more precise, as similar to the piezoelectric elements 3*a*, the liquid chambers 5*a* are arranged in two lines on both sides of the straight line passing through the orifices 7*a* defined as the center, i.e. four lines in total. In this case, the liquid chambers 5*a* arranged in the two lines are cyclically provided into a triangular waveform at the pitch L2. The lines are separated from each other at the interval distance L3. Moreover, as shown in FIG. 4, the liquid passages 6*a* include multiple first arc wall surfaces H1 arranged in one line, multiple second arc wall surfaces H2 cyclically arranged in a triangular waveform, and multiple wall surfaces H3 respectively connecting the first arc wall surfaces and the second wall surfaces continuously. In addition, each of the liquid passages 6*a* is formed so as to have a shape which becomes gradually narrower toward the nozzle orifice 6*c* (the nozzle 6*b*) in the plane of the nozzle plate 6. Specifically, each of the liquid passages 6*a* is formed gradually narrower in the direction of the flow of the liquid. In this way, it is possible to prevent interference between the liquid passages 6*a* even when a droplet jetting head 1 with a narrow nozzle pitch is manufactured.

Referring back to FIG. 1, the holder plate 8 is made of a material having higher compressive strength than the nozzle plate 6 such as a metallic material. This holder plate 8 is provided with the aperture 8*a* formed so as to expose the orifice plate 7, and multiple screw holes N4 for inserting the screws 10. The aperture 8*a* is provided substantially in the center of the holder plate 8 and is formed into the shape to expose the orifice plate, for example, a rectangular shape. Meanwhile, the screw holes N4 are through holes penetrating the holder plate 8, and are provided in a peripheral portion of the holder plate 8. These screw holes N4 are formed by counter boring, for example. Here, each of the screw holes N4 is formed in a position collinear with the screw hole N1.

The buffer member 9 is formed into an annular shape, for example, and is provided around the protrusion 6*c* of the nozzle plate 6. This buffer member 9 prevents contact between the nozzle plate 6 and the holder plate 8. An elastic member is used for this buffer member 9, for example. The material of the elastic member may be polytetrafluoroethylene (PTFT): ethylene tetrafluoride resin, silicone or Kalrez, for example.

Each of the screws 10 is formed into a bar, for example, and is inserted in the screw holes N1, N2, N3, and N4. The screws 10 fix the vibration plate 4, the liquid chamber plate 5, and the holder plate 8 to the base member 2. In this case, the nozzle plate 6 is sandwiched and fixed between the liquid chamber plate 5 and the holder plate 8. Screw threads for male screws are formed on the screws 10, for example. The base member 2, the vibration plate 4, the liquid chamber plate 5, and the holder plate 8 are fastened together by these screws 10.

In the droplet jetting head 1 described above, the piezoelectric element 3*a* is contracted when a voltage is applied thereto (voltage application on) to cause deformation of the vibration plate 4 and an increase of the volume of the corresponding liquid chamber 5*a*. At this time, the liquid chamber 5*a* having the increased volume is refilled with the liquid supplied from the main passage 5*b*. Thereafter, when the voltage application to the piezoelectric element 3*a* is stopped (voltage application off), the vibration plate 4 recovers the original shape so that the corresponding liquid chamber 5*a* has the original volume. At this time, the liquid inside the liquid chamber 5*a* is pressurized so that the liquid is jetted from the orifice 7*a* as droplets through the liquid passage 6*a*.

In such droplet jetting head 1, the piezoelectric elements 3*a* and the liquid chambers 5*a* are cyclically arranged in the triangular waveform. Therefore, the distance between each of the nozzles 6*b* and the corresponding liquid chamber 5*a* communicating with the nozzle 6*b* is changed in a cycle of two adjacent nozzles 6*b*. In this way, even when the number of nozzles (the number of the orifices 7*a*) is increased, it is possible to reduce the pitch of the orifices 7*a* while maintaining a minimum distance (L1×2) required for avoiding the adjacent piezoelectric elements 3*a* from interfering with each other. This prevents the droplet jetting head 1 from extending in the aligning direction of the orifices 7*a* (the direction of arrangement of the orifices 7*a*).

As described above, according to the embodiment of the present invention, by arranging the piezoelectric elements 3*a* and the liquid chambers 5*a* cyclically in the triangular waveform, even in the case of increasing the number of nozzles, it is possible to increase the number of the piezoelectric elements 3*a* and to reduce the pitch of the orifices 7*a* while maintaining the minimum distance (L1×2) required for avoiding the adjacent piezoelectric elements 3*a* from interfering with each other. As a result, a size increase of the droplet jetting head 1 due to the increase in the number of nozzles can be prevented as well as a weight increase of the droplet jetting head 1. Particularly, by downsizing the droplet jetting head 1, it is possible to improve the layout freedom of the droplet jetting head 1 in the droplet jetting applicator.

Moreover, since the liquid passages 6*a* is formed to become gradually narrower in the direction of the flow of the liquid, interference between the liquid passages 6*a* can be prevented even when the nozzle pitch is reduced. Hence, it is possible to manufacture the droplet jetting head 1 with a narrower nozzle pitch.

The droplet jetting applicator is configured of the foregoing droplet jetting head 1 and the body which holds the droplet jetting head 1 and supplies the liquid such as ink to the droplet jetting head 1. In this way, the droplet jetting applicator is required only to hold such small droplet jetting head 1, thereby enabling the simplification of the holding mechanism for holding the droplet jetting head 1 and eliminating the need for reinforcing the mechanism, for example.

Other Embodiments

The present invention is not limited only to the above-described embodiment and various modifications are possible without departing from the scope of the gist of the invention.

For example, the piezoelectric elements 3*a* are arranged in four lines in the above-described embodiment. However, the present invention is not limited only to this configuration. It is also possible to arrange the piezoelectric elements 3*a* in three lines or five lines, for example. Likewise, the liquid chambers 5*a* are arranged in four lines. However, without limitations to the foregoing, it is also possible to arrange the liquid chambers 5*a* in three lines or five lines, for example.

Meanwhile, in the above-described embodiment, the vibration plate 4 is fixed between the base member 2 and the liquid chamber plate 5 by using the screws 10. However, the present invention is not limited only to this configuration. For example, the vibration plate 4 may be attached and fixed between the base member 2 and the liquid chamber plate 5 by using an adhesive agent in addition to the screws 10.

Moreover, in the above-described embodiment, the buffer member 9 is formed into an annular shape and the single buffer member 9 is provided on the nozzle plate 6. However, the present invention is not limited only to this configuration. For example, it is also possible to form the buffer member into a rectangular shape or a disc shape, or to provide more than one buffer members 9 on the nozzle plate 6.

Lastly, in the above-described embodiment, screw threads for constituting female screws are not formed inside the screw holes N4. However, the present invention is not limited only to this configuration. For example, the screw threads for the female screws may be formed inside the screw holes N4.

What is claimed is:

1. A droplet jetting head comprising:

a nozzle plate including a plurality of nozzles arranged in a single line and a plurality of liquid passages which communicate with the plurality of nozzles, respectively, and which extend in the same direction, wherein the plurality of liquid passages are respectively formed by a plurality of first arc wall surfaces arranged in one line, a plurality of second arc wall surfaces cyclically arranged in a triangular waveform, and a plurality of wall surfaces connecting the first arc wall surfaces and the second wall surfaces continuously;

a liquid chamber plate including a plurality of liquid chambers provided in the plurality of liquid passages and configured to respectively communicate with the plurality of liquid passages; and a plurality of piezoelectric elements provided so that an end of each of the piezoelectric elements faces a corresponding one of the plurality of liquid chambers, wherein a distance between each of the nozzles and the corresponding liquid chamber communicating with the nozzle is changed in a cycle.

2. The droplet jetting head according to claim 1, wherein the distance is changed in a cycle of two adjacent nozzles.

3. The droplet jetting head according to claim 1, wherein the plurality of liquid passages are each formed to become narrower gradually in a direction of a flow of the fluid.

* * * * *